US009580812B2

(12) United States Patent
Uchikawa et al.

(10) Patent No.: US 9,580,812 B2
(45) Date of Patent: Feb. 28, 2017

(54) CHEMICAL CONVERSION TREATMENT AGENT FOR SURFACE TREATMENT OF METAL SUBSTRATE, AND SURFACE TREATMENT METHOD OF METAL SUBSTRATE USING SAME

(75) Inventors: Keita Uchikawa, Tokyo (JP); Kiyoto Fuse, Tokyo (JP)

(73) Assignee: Chemetall GmbH (DE)

( * ) Notice: Subject to any disclaimer, the term of this patent is extended or adjusted under 35 U.S.C. 154(b) by 564 days.

(21) Appl. No.: 14/117,096

(22) PCT Filed: May 9, 2012

(86) PCT No.: PCT/JP2012/061887

§ 371 (c)(1),
(2), (4) Date: Mar. 27, 2014

(87) PCT Pub. No.: WO2012/153766

PCT Pub. Date: Nov. 15, 2012

(65) Prior Publication Data

US 2014/0190592 A1 Jul. 10, 2014

(30) Foreign Application Priority Data

May 9, 2011 (JP) ..... 2011-104155

(51) Int. Cl.
*C23C 22/34* (2006.01)
*C23C 22/48* (2006.01)

(52) U.S. Cl.
CPC ..... *C23C 22/34* (2013.01); *C23C 2222/20* (2013.01)

(58) Field of Classification Search
CPC .... C23C 22/34; C23C 22/361; C23C 2222/20
USPC ..... 148/247
See application file for complete search history.

(56) References Cited

U.S. PATENT DOCUMENTS

| | | | | |
|---|---|---|---|---|
| 8,075,708 | B2 | 12/2011 | Matsukawa et al. | |
| 2008/0081212 | A1* | 4/2008 | Inbe | C09D 183/08 428/651 |
| 2009/0065099 | A1 | 3/2009 | Makino et al. | |

FOREIGN PATENT DOCUMENTS

| | | | |
|---|---|---|---|
| JP | 2006-241579 | A | 9/2006 |
| JP | 2006-328445 | A | 12/2006 |
| JP | 2007-262577 | A | 10/2007 |
| JP | 2008-184690 | A | 8/2008 |

* cited by examiner

*Primary Examiner* — Lois Zheng

(57) ABSTRACT

Chemical conversion treatment agents for surface treating a metal substrate and a method for surface treating a metal substrate using the same are described in this disclosure. The chemical conversion agent includes at least one metal element, a fluorine element, and a co-condensate of a first silane coupling agent (A) and a second silane coupling agent (B).

21 Claims, No Drawings

CHEMICAL CONVERSION TREATMENT AGENT FOR SURFACE TREATMENT OF METAL SUBSTRATE, AND SURFACE TREATMENT METHOD OF METAL SUBSTRATE USING SAME

This application is a §371 of International Application No. PCT/JP2012/061887 filed May 9, 2012, and claims priority from Japanese Patent Application No. 2011-104155 filed May 9, 2011.

TECHNICAL FIELD

The present invention relates to a chemical conversion treatment agent for surface treatment of a metal substrate, and a method for surface treatment of a metal substrate using the chemical conversion treatment agent.

BACKGROUND ART

In the coating of workpieces such as metal substrates, chemical conversion treatments have been conventionally performed on the surfaces of the metal substrates by using various chemical conversion treatment agents in order to form chemical conversion coating films on the surfaces of the metal substrates and thereby secure the adhesion of coat films and corrosion resistance. A known example of the chemical conversion treatments is the chromate chemical conversion treatment using a chemical conversion treatment agent (a chromic acid salt or the like) containing chromium. However, it has been pointed out that the chromate chemical conversion treatment is hazardous because of chromium. Moreover, another known example of the chemical conversion treatments is a chemical conversion treatment using a chemical conversion treatment agent containing a so-called zinc phosphate. However, the chemical conversion treatment agent containing zinc phosphate has a high metal ion concentration and a high acid concentration and is extremely highly reactive, in general. Hence, the chemical conversion treatment using the chemical conversion treatment agent containing zinc phosphate has a problem of requiring waste-water treatment. In addition, the chemical conversion treatment using a chemical conversion treatment agent containing zinc phosphate also has a problem that deposit called sludge is formed due to formation of water-insoluble salts, and that a removal and disposal of the sludge is necessary. As described above, the chemical conversion treatment using a chemical conversion treatment agent containing zinc phosphate has problems in terms of economical efficiency and workability. For this reason, studies are being made recently on chemical conversion treatments using chemical conversion treatment agents other than the chemical conversion treatments agent containing chromium and the chemical conversion treatment agent containing zinc phosphate.

For example, Japanese Unexamined Patent Application Publication No. 2007-262577 (PTL 1) discloses a chemical conversion treatment agent containing a zirconium compound and/or a titanium compound and an organosiloxane. Moreover, PTL 1 shows examples of the organosiloxane such as a co-condensate of 3-aminopropyltriethoxysilane and 3-glycidoxypropyltrimethoxysilane (described in Example 6 in PTL 1) and a co-condensate of N-2-(aminoethyl)-3-aminopropyltrimethoxysilane and 3-glycidoxypropyltrimethoxysilane (described in Example 17 of PTL 1).

However, conventional chemical conversion treatment agents as described in PTL 1 are not necessarily sufficient in terms of coat film adhesion.

CITATION LIST

Patent Literature

[PTL 1] Japanese Unexamined Patent Application Publication No. 2007-262577

SUMMARY OF INVENTION

Technical Problem

The present invention has been made in view of the problems of the above-described conventional technologies. An object of the present invention is to provide a chemical conversion treatment agent for surface treatment of a metal substrate, the chemical conversion treatment agent being capable of imparting a sufficiently high level of coat film adhesion, and to provide a method for surface treatment of a metal substrate using the chemical conversion treatment agent.

Solution to Problem

To achieve the above object, the present inventors have conducted earnest study. As a result, the present inventors have found that a sufficiently high level of coat film adhesion can be imparted by a chemical conversion treatment agent for a surface of a metal substrate, the chemical conversion treatment agent comprising: at least one metal element selected from the group consisting of zirconium, titanium, and hafnium; fluorine element; and a co-condensate of a silane coupling agent (A) and a silane coupling agent (B), wherein the silane coupling agent (A) is a silane coupling agent having a tri- or di-alkoxysilane group and an amino group, and the silane coupling agent (B) is a silane coupling agent represented by the general formula (1) shown below. This finding has led to the completion of the present invention.

Specifically, the chemical conversion treatment agent of the present invention is a chemical conversion treatment agent for surface treatment of a metal substrate, comprising:

at least one metal element selected from the group consisting of zirconium, titanium, and hafnium;

fluorine element; and a co-condensate of a silane coupling agent (A) and a silane coupling agent (B), wherein the silane coupling agent (A) is a silane coupling agent having a tri- or di-alkoxysilane group and an amino group, and the silane coupling agent (B) is a silane coupling agent represented by the following general formula (1):

[Chem. 1]

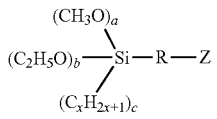

(1)

[in the formula,

R represents one selected from the group consisting of alkylene groups having 1 to 5 carbon atoms, alkyleneoxy groups having 1 to 5 carbon atoms, and an oxygen atom, Z represents one selected from the group consisting of cyclohexyl groups each optionally having at least one of an epoxy group and an amino group as a substituent and aromatic ring groups each optionally having at least one of a vinyl group, an epoxy group, and an amino group as a substituent, a, b, and c each represent an integer of 0 to 3, provided that a sum of a, b, and c is 3, and a sum of a and b is 2 to 3, and x represents an integer of 1 to 3].

In the chemical conversion treatment agent of the present invention, the silane coupling agent (A) preferably comprises at least one selected from the group consisting of 3-aminopropyltriethoxysilane, 3-aminopropyltrimethoxysilane, 3-aminopropylmethyldiethoxysilane, 3-aminopropylmethyldimethoxysilane, N-(2-aminoethyl)-3-aminopropyltrimethoxysilane, N-(2-aminoethyl)-3-aminopropylmethyldimethoxysilane, N-(2-aminoethyl)-3-aminopropyltriethoxysilane and N-(2-aminoethyl)-3-aminopropyldimethoxysilane.

Moreover, in the chemical conversion treatment agent of the present invention, Z in the general formula (1) is preferably at least one selected from the group consisting of a 3,4-epoxycyclohexyl group, a phenyl group, a cyclohexyl group, and a styryl group.

In addition, the chemical conversion treatment agent of the present invention preferably further comprises at least one selected from the group consisting of aluminum, magnesium, zinc, calcium, strontium, indium, tin, copper, and silver.

Furthermore, in the chemical conversion treatment agent of the present invention, the co-condensate of the silane coupling agent (A) and the silane coupling agent (B) is preferably a co-condensate obtained by polymerizing a mixture of the silane coupling agent (A) and the silane coupling agent (B) in a mass ratio ((A):(B)) which is in a range from 1:9 to 18:1.

Moreover, in the chemical conversion treatment agent of the present invention, a content (total amount) of the metal element is preferably 50 to 1000 ppm in terms of the element.

In addition, in the chemical conversion treatment agent of the present invention, a total content of the silane coupling agent (A) and the silane coupling agent (B) (including the co-condensate) is preferably 200 ppm or more in terms of solid content concentration.

Furthermore, the chemical conversion treatment agent of the present invention is preferably such that the fluorine element is partially present as free fluorine ions in the chemical conversion treatment agent, and a content of the free fluorine ions in the chemical conversion treatment agent is 0.01 to 100 ppm.

Meanwhile, a method for surface treatment of a metal substrate of the present invention is a method comprising bringing the above-described chemical conversion treatment agent of the present invention into contact with a surface of a metal substrate, to thereby form a chemical conversion coating film on the surface of the metal substrate.

Advantageous Effects of Invention

The present invention makes it possible to provide a chemical conversion treatment agent for surface treatment of a metal substrate, the chemical conversion treatment agent being capable of imparting a sufficiently high level of coat film adhesion, and to provide a method for surface treatment of a metal substrate using the chemical conversion treatment agent.

DESCRIPTION OF EMBODIMENTS

Hereinafter, the present invention will be described in detail on the basis of preferred embodiments thereof.

First, a chemical conversion treatment agent of the present invention is described. Specifically, the chemical conversion treatment agent of the present invention is a chemical conversion treatment agent for surface treatment of a metal substrate, comprising:

at least one metal element selected from the group consisting of zirconium, titanium, and hafnium;

fluorine element; and a co-condensate of a silane coupling agent (A) and a silane coupling agent (B), wherein the silane coupling agent (A) is a silane coupling agent having a tri- or di-alkoxysilane group and an amino group, and the silane coupling agent (B) is a silane coupling agent represented by the following general formula (1):

[Chem. 2]

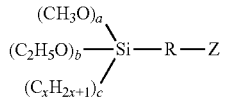

(1)

[in the formula,

R represents one selected from the group consisting of alkylene groups having 1 to 5 carbon atoms, alkyleneoxy groups having 1 to 5 carbon atoms, and an oxygen atom, Z represents one selected from the group consisting of cyclohexyl groups each optionally having at least one of an epoxy group and an amino group as a substituent and aromatic ring groups each optionally having at least one of a vinyl group, an epoxy group, and an amino group as a substituent, a, b, and c each represent an integer of 0 to 3, provided that a sum of a, b, and c is 3, and a sum of a and b is 2 to 3, and x represents an integer of 1 to 3].

The chemical conversion treatment agent comprises at least one metal element selected from the group consisting of zirconium, titanium, and hafnium (hereinafter, referred to as "metal element (A)" in some cases). The at least one metal element (A) selected from the group consisting of zirconium, titanium, and hafnium is a component used for forming a chemical conversion coating film after a chemical conversion treatment. The formation of the chemical conversion coating film comprising the metal element (A) by using the chemical conversion treatment agent makes it possible to improve corrosion resistance and wear resistance of the metal substrate. In addition, the metal element (A) is more preferably zirconium or titanium, and further preferably zirconium, from the viewpoint of an ability to from the chemical conversion coating film.

The zirconium element is preferably contained in the chemical conversion treatment agent as a zirconium compound. The zirconium compound is not particularly limited, and examples thereof include including alkali metal fluorozirconates such as $K_2ZrF_6$, fluorozirconates such as $(NH_4)_2ZrF_6$, soluble fluorozirconates such as $H_2ZrF_6$, zirconium fluoride (fluorozirconic acid), zirconium oxide, zirconylnitrate, zirconiumcarbonate, and the like. As the zirconium compound, zirconium fluoride (fluorozirconic acid) is more preferably used from the viewpoints of ease of availability and enhancement of the ability to from the chemical conversion coating film.

Meanwhile, the titanium element is preferably contained in the chemical conversion treatment agent as a titanium compound. The titanium compound is not particularly limited, and examples thereof include soluble fluorotitanates including alkali metal fluorotitanates, fluorotitanates such as $(NH_4)_2TiF_6$, fluorotitanic acid such as $H_2TiF_6$, and the like; titanium fluoride; titanium oxide; and the like. As the titanium compound, titanium fluoride (particularly preferably, fluorotitanic acid) is more preferably used, from the viewpoints of ease of availability and enhancement of the ability to from the chemical conversion coating film.

In addition, the hafnium element is preferably contained in the chemical conversion treatment agent as a hafnium compound. Examples of the hafnium compound include fluorohafnic acids such as $H_2HfF_6$, hafnium fluoride, and the like. As the hafnium compound, hafnium fluoride is more preferably used from the viewpoints of ease of availability and enhancement of the ability to from the chemical conversion coating film.

A content of the at least one metal element (A) selected from the group consisting of zirconium, titanium, and hafnium is preferably 50 to 1000 ppm in terms of the element. If the content of the metal element (A) is less than the lower limit, a chemical conversion coating film with a sufficient coated amount cannot be formed on the metal substrate, so that it is difficult to sufficiently improve the adhesion of a coat film, in some cases. Meanwhile, if the content exceeds the upper limit, the tendency toward increase of the coated amount tends to occur less likely. For these reasons, a total amount of the content of the metal element (A) is more preferably 50 to 800 ppm, and further preferably 100 to 500 ppm. Note that, for the chemical conversion treatment agent of the present invention, water is used as a solvent, and the unit "ppm" for the concentration represents a concentration (mg/L) per liter of the chemical conversion treatment agent.

In addition, the chemical conversion treatment agent of the present invention comprises fluorine element. In the present invention, the fluorine element is a component which may be utilized as an etchant for the surface of the metal substrate or a complexing agent for the metal element (A). The fluorine element may be introduced into the chemical conversion treatment agent by using a fluoride (for example, zirconium fluoride) as the above-described zirconium compound and/or titanium compound and/or hafnium compound (the compound of the metal element (A): a source of the metal element (A)), or may be supplied to the chemical conversion treatment agent by a compound (other fluorine compound) other than the compound of the metal element (A). Examples of the other fluorine compound include hydrofluoric acid, ammonium fluoride, fluoroboric acid, ammonium hydrogenfluoride, sodium fluoride, sodium hydrogenfluoride, and the like. Moreover, for example, a hexafluoro silicate may also be used as the other fluorine compound. Specific examples of the hexafluoro silicate include complex fluorides such as fluorosilicic acid, zinc fluorosilicate, manganese fluorosilicate, magnesium fluorosilicate, nickel fluorosilicate, iron fluorosilicate, calcium fluorosilicate, and the like.

In addition, in the chemical conversion treatment agent of the present invention, a ratio ([fluorine element]/[the metal element (A)]) of number of element of the fluorine element relative to the metal element (A) is preferably 5 or higher. If the ratio of number of element is less than 5, the formation of the chemical conversion coating film tends to be insufficient because of deterioration in the storage stability or deterioration of the ability to etch the surface of the metal substrate due to formation of deposits. The ratio of number of element of the fluorine element relative to the metal element is more preferably 5 to 6. If the content of the fluorine element exceeds 6, the formation of the chemical conversion coating film containing the metal element tends to be insufficient, because the etching of the surface of the metal substrate proceeds too much more than needs in the chemical conversion treatment.

In the chemical conversion treatment agent of the present invention, the fluorine element is preferably partially present as free fluorine ions in the chemical conversion treatment agent. A content of the free fluorine ions is preferably 0.01 to 100 ppm in terms of the element. Here, "the content of free fluorine ions" means a concentration of fluorine ions in a free state in the chemical conversion treatment agent, and a value is employed which is measured by using a meter (for example, trade name "ION METER IM-55G" manufactured by DDK-TOA CORPORATION) having a fluorine ion electrode. If the content of the free fluorine ions in the chemical conversion treatment agent is less than the lower limit, the formation of the chemical conversion coating film may be insufficient, in some cases, because of deterioration of the storage stability or deterioration of the ability to etch the surface of the metal substrate due to formation of deposits. Meanwhile, if the content of the free fluorine ions exceeds the upper limit, the formation of the chemical conversion coating film containing the metal element tends to be insufficient, because the etching of the surface of the metal substrate proceeds more than needs in the chemical conversion treatment. In addition, when the content of the free fluorine ions in the chemical conversion treatment agent is within the above-described range, the anti-rust property and the adhesion of a coat film tend to be more improved. From the same viewpoint, the content of the free fluorine ions is more preferably 1 to 50 ppm, and further preferably 5 to 30 ppm.

In addition, the chemical conversion treatment agent of the present invention comprises a co-condensate of a silane coupling agent (A) and a silane coupling agent (B). When the co-condensate of the silane coupling agent (A) and the silane coupling agent (B) is contained in the chemical conversion treatment agent, the co-condensate is incorporated in the chemical conversion coating film. As a result, the adhesion to the metal substrate can be improved by a functional group originated from the silane coupling agent (A). Moreover, the hydrophobicity of the chemical conversion coating film formed in the chemical conversion treatment can be improved by a functional group originated from the silane coupling agent (B). Hence, a sufficiently high level of coat film adhesion can be imparted to the chemical conversion coating film.

Such a silane coupling agent (A) is a silane coupling agent having a tri- or di-alkoxysilane group and an amino group. The silane coupling agent (A) is not particularly limited, as long as the silane coupling agent (A) has a tri- or di-alkoxysilane group and an amino group. For example, a silane coupling agent can be used, as appropriate, which is represented by the following general formula (2):

$$R^1_m(R^2O)_{3-m}Si—R^3—NH_2 \quad (2)$$

[in the formula, m is 0 or 1, $R^1$ represents any one group selected from a hydroxy group (—OH) and alkyl groups having 1 to 6 carbon atoms, $R^2$s each independently represent an alkyl group having 1 to 5 (more preferably 1 to 3) carbon atoms, and $R^3$ represents any one group selected from alkylene groups having 1 to 6 (more preferably 2 to 4) carbon atoms and a group represented by the formula: $—C_3H_6NHC_2H_4—NHC_2H_4—$].

The silane coupling agent (A) is not particularly limited. The silane coupling agent (A) is preferably 3-aminopropyltriethoxysilane, 3-aminopropyltrimethoxysilane, 3-aminopropylmethyldiethoxysilane, 3-aminopropylmethyldimethoxysilane, N-(2-aminoethyl)-3-aminopropyltrimethoxysilane, N-(2-aminoethyl)-3-aminopropylmethyldimethoxysilane, N-(2-aminoethyl)-3-aminopropyltriethoxysilane, or N-(2-aminoethyl)-3-aminopropyldiethoxysilane, and more preferably 3-aminopropyltriethoxysilane, 3-aminopropyltrimethoxysilane, N-(2-aminoethyl)-3-aminopropyltrimethoxysilane N-(2-aminoethyl)-3-aminopropylmethyldimethoxysilane, or N-(2-aminoethyl)-3-aminopropyltriethoxysilane. Note that one of these silane coupling agents (A) may be used alone, or two or more thereof may be used in combination. Moreover, as the silane coupling agent (A), a commercially available silane coupling agent may be used (for example, those manufactured by Shin-Etsu Chemical Co., Ltd., under the trade names of "KBM603" and "KBM903" and the like).

Meanwhile, the silane coupling agent (B) is a silane coupling agent represented by the following general formula (1):

[Chem. 3]

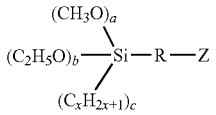

(1)

R in the general formula (1) is one group or atom selected from the group consisting of alkylene groups having 1 to 5 carbon atoms, alkyleneoxy groups having 1 to 5 carbon atoms, and an oxygen atom. If the number of carbon atoms of such an alkylene group or alkyleneoxy group exceeds the upper limit, the solubility decreases, and the reactivity decreases. In addition, the alkylene groups and alkyleneoxy groups which may be selected as R each preferably have 1 to 3 carbon atoms. In addition, R in the general formula (1) is more preferably an alkylene group having 1 to 3 carbon atoms or an oxygen atom.

Z in the general formula (1) is one selected from the group consisting of cyclohexyl groups each optionally having at least one of an epoxy group and an amino group as a substituent and aromatic ring groups each optionally having at least one of a vinyl group, an epoxy group, and an amino group as a substituent. When Z in the general formula (1) is the one selected from the group consisting of cyclohexyl groups each optionally having at least one of an epoxy group and an amino group as a substituent and aromatic ring groups each optionally having at least one of a vinyl group, an epoxy group, and an amino group as a substituent, the hydrophobicity of the obtained co-condensate is high. Consequently, when the co-condensate is incorporated into the chemical conversion coating film formed by the chemical conversion treatment agent of the present invention, the hydrophobicity of the surface of the chemical conversion coating film can be improved, so that the adhesion between the coat film and the chemical conversion coating film after baking of the coating material is sufficiently improved.

In addition, Z is more preferably a 3,4-epoxycyclohexyl group, a phenyl group, a cyclohexyl group, or a styryl group, and particularly preferably a 3,4-epoxycyclohexyl group, or a phenyl group.

Moreover, a, b, and c in the general formula (1) are each an integer of 0 to 3, provided that a sum of a, b, and c is 3, and a sum of a and b is 2 to 3. If the sum of a and b is 1, in other words, if c is 2, the reactivity of the silane coupling agent (B) is so low that the co-condensate of the silane coupling agents (A) and (B) is difficult to obtain. For this reason, c is an integer of any of 0 and 1, and c is more preferably 0 from the viewpoint of the reactivity. In addition, the sum of a and b is preferably 3, from the viewpoint of the reactivity of the silane coupling agent (B). Meanwhile, from the viewpoints of ease of preparation and the like, it is more preferable that one of a and b be 3 (particularly preferably a be 3), or one of a and b be 2 (particularly preferably a be 2).

In addition, x in the general formula (1) is an integer of 1 to 3. If x exceeds the upper limit, the solubility tends to be lowered. Moreover, the value of x is preferably 1 to 2 from the viewpoint of the solubility.

Furthermore, the silane coupling agent (B) represented by the general formula (1) is preferably 2-(3,4-epoxycyclohexyl)ethyltrimethoxysilane or phenoxytrimethoxysilane, and particularly preferably 2-(3,4-epoxycyclohexyl)ethyltrimethoxysilane or phenoxytrimethoxysilane. Note that one of these silane coupling agents (B) may be used alone, or two or more thereof may be used in combination. In addition, as the silane coupling agent (B), a commercially available silane coupling agent may be used (for example, those manufactured by Shin-Etsu Chemical Co., Ltd., under the trade name of "KBM303" and "KBM103" and the like).

Moreover, the co-condensate of the silane coupling agent (A) and the silane coupling agent (B) is not particularly limited, as long as the co-condensate is obtained by polymerizing the silane coupling agent (A) and the silane coupling agent (B). The co-condensate is more preferably a co-condensate obtained by polymerizing a mixture of the silane coupling agent (A) and the silane coupling agent (B) in a mass ratio ((A):(B)) which is in a range from 1:9 to 18:1 (more preferably 1:1 to 18:1, and further preferably 7:3 to 9:1). If the mass ratio of the silane coupling agent (A) in the mixture is lower than the lower limit, the adhesion between the chemical conversion coating film and the substrate tends to be lowered. Meanwhile, if the mass ratio exceeds the upper limit, the hydrophobicity is lowered, so that an effect achieved by the chemical conversion coating film tends to decrease.

In addition, a method for polymerizing the silane coupling agent (A) and the silane coupling agent (B) is not particularly limited, and a known method which enables the polymerization of the silane coupling agent (A) and the silane coupling agent (B) can be employed, as appropriate. For example, a method may be employed in which the mixture of the silane coupling agent (A) and the silane coupling agent (B) is introduced into a water-based solvent (preferably water), and the obtained reaction liquid is subjected to a hydrolytic condensation with heating and stirring, if necessary.

Moreover, when such a method for hydrolytic condensation of the silane coupling agent (A) and (B) is employed, the value of pH of the reaction liquid at the hydrolysis is preferably 13 or lower, and more preferably 7 or lower. If the value of pH exceeds the upper limit, the stability of the chemical conversion treatment agent is lowered, so that deposits tend to be formed.

In addition, in the chemical conversion treatment agent of the present invention, the silane coupling agent (A) and/or the silane coupling agent (B) which are unreacted may be present together with the co-condensate of the silane coupling agent (A) and the silane coupling agent (B). Specifically, a reaction liquid in which the silane coupling agent (A) and the silane coupling agent (B) are mixed, and subjected to the co-condensation contains the silane coupling agent (A) and/or the silane coupling agent (B) remaining as unreacted materials, in addition to the co-condensate. However, the reaction liquid or the like can be used as it is. Note that the unreacted silane coupling agents herein refer to silane coupling agents which are not polymerized, and also include those which are once converted into a polymerization product by the polymerization, and then produced by hydrolysis.

In the reaction liquid of the silane coupling agent (A) and the silane coupling agent (B), the condensation ratio of the silane coupling agent (A) and/or the silane coupling agent (B) is preferably 50% or higher, and more preferably 60% or higher. If the condensation ratio in the reaction liquid is too low, the amount of the co-condensate of the silane coupling agent (A) and the silane coupling agent (B) may be insufficient in some cases, after incorporation into the chemical conversion treatment agent.

The condensation ratio herein refers to a condensation ratio determined from the following mathematical expression (1):

[condensation ratio (%)]=[total mass of condensate]×100/([total mass of condensate]+[total mass of unreacted monomers]) Mathermatical Expression (1).

Here, when the silane coupling agents used as the raw materials are each represented by $R^{11}$—$Si(OR^{12})_3$ ($R^{12}$ is an alkyl group), substances represented by $R^{11}$—$Si(OR^{12})_n(OH)_{3-n}$ (n=0, 1, 2, or 3) are regarded as monomers, and the others are regarded as the condensate.

In addition, in the chemical conversion treatment agent of the present invention, a total content of the silane coupling agent (A) and the silane coupling agent (B) (including the co-condensate) is preferably 200 ppm or more based on the mass of solid contents (in terms of solid content concentration). If the content is less than the lower limit, it tends to be difficult to obtain a sufficiently high adhesion of a coat film. Meanwhile, if the content exceeds 1000 ppm, the adhesion is not improved any further. Hence, an appropriate upper limit is 1000 ppm. In addition, from the same viewpoint, the total content of the silane coupling agent (A) and the silane coupling agent (B) (including the co-condensate) is more preferably 300 ppm to 1000 ppm, and further preferably 500 to 1000 ppm.

In addition, a mass ratio ([the total amount of the metal element (A)]/[the total content of the silane coupling agent (A) and the silane coupling agent (B) (including the co-condensate)]) of the total amount of the metal element (A) contained in the chemical conversion treatment agent of the present invention to the total content (solid content) of the silane coupling agent (A) and the silane coupling agent (B) (including the co-condensate) in the chemical conversion treatment agent is preferably 0.1 to 10. If the mass ratio is lower than the lower limit, the formation of the chemical conversion coating film from the metal element (A) is inhibited, and the formation of the chemical conversion coating film from the co-condensate is also inhibited. Hence, it tends to be difficult to sufficiently improve the adhesion of a coat film and the corrosion resistance. Meanwhile, if the mass ratio exceeds the upper limit, the co-condensate is not incorporated sufficiently in the chemical conversion coating film. Hence, it tends to be difficult to sufficiently improve the adhesion. In addition, from the same viewpoint, the mass ratio is more preferably 1 to 5.

Moreover, the chemical conversion treatment agent of the present invention preferably further comprises at least one (hereinafter, referred to as "metal element (B)" in some cases) selected from the group consisting of aluminum, magnesium, zinc, calcium, strontium, indium, tin, copper, and silver. When the metal element (B) is further contained, it tends to be possible to further improve the coat film adhesion after the chemical conversion treatment. In addition, the metal element (B) may be contained as a compound of the metal element (B) (for example, a sulfuric acid salt, an acetic acid salt, a halide (for example, a fluoride), a nitric acid salt, or the like of the metal element (B)). In addition, the metal element (B) is more preferably aluminum, because higher adhesion and higher corrosion resistance can be imparted. Note that one of these metal elements (B) may be used alone, or two or more thereof may be used in combination.

When the metal element (B) is contained in the chemical conversion treatment agent of the present invention, a total amount (content) of the metal element (B) is preferably 10 to 1000 ppm, in terms of the element, relative to all the elements in the chemical conversion treatment agent. If the total amount is less than the lower limit, it tends to difficult to obtain the coat film adhesion after the chemical conversion treatment. Meanwhile, if the total amount exceeds the upper limit, the effect on the coat film adhesion after the chemical conversion treatment tends to be saturated.

When the aluminum is contained, which is preferable as the metal element (B), the mass ratio ([mass of F]/[mass of Al]) of the fluorine element to the aluminum is preferably 1.9 or higher. If the mass ratio is less than the lower limit, the compound of the metal element (B), which is the aluminum source, tends to be unstable in the chemical conversion treatment agent.

In addition, the chemical conversion treatment agent of the present invention may further comprise at least one surfactant selected from nonionic surfactants, anionic surfactants, cationic surfactants, and amphoteric surfactants. As the surfactants, known surfactants can be used, as appropriate. When a surfactant is contained as described above, it tends to be possible to form a chemical conversion coating film in a sufficiently efficient manner, even when a degreasing treatment is not performed on the surface of the metal substrate in advance.

Moreover, the chemical conversion treatment agent of the present invention may further comprise an oxidizing agent, from the viewpoint of further promoting the formation reaction of the chemical conversion coating film in the chemical conversion treatment. Examples of the oxidizing agent include nitric acid, nitrous acid, sulfuric acid, sulfurous acid, persulfuric acid, phosphoric acid, carboxylic acid group-containing compounds, sulfonic acid group-containing compounds, hydrochloric acid, bromic acid, chloric acid, hydrogen peroxide, $HMnO_4$, $HVO_3$, $H_2WO_4$, $H_2MoO_4$, and oxoacid salts thereof.

In addition, a value of pH of the chemical conversion treatment agent of the present invention is preferably 1.5 to 6.5, more preferably 2.0 to 5.0, and particularly preferably 2.5 to 4.5. If the value of pH is lower than the lower limit, the surface of the metal substrate is excessively etched by the chemical conversion treatment agent, so that it becomes difficult to sufficiently form the chemical conversion coating film, and the chemical conversion coating film is non-uniformly formed, which tend to adversely affect the appearance of a coat film. Meanwhile, if the value of pH exceeds the upper limit, it is not possible to sufficiently etch the surface of the metal substrate with the chemical conversion treatment agent, so that it tends to be difficult to sufficiently form the chemical conversion coating film. Note that the value of pH can be adjusted, as appropriate, by using, as a pH adjusting agent, an acidic compound such as nitric acid or sulfuric acid or a basic compound such as sodium hydroxide, potassium hydroxide, or ammonia.

In addition, when the chemical conversion treatment is performed by using the chemical conversion treatment agent of the present invention, the kind of the metal substrate used is not particularly limited, and any metal substrate can be used, as appropriate, as long as the metal substrate needs to be subjected to the chemical conversion treatment. The metal substrate will be described in further detail in the description of a method for surface treatment of a metal substrate of the present invention below. Note that, when a surface treatment is performed on a metal substrate by using the chemical conversion treatment agent of the present invention, the following reaction presumably proceeds, so that the chemical conversion coating film is formed on the surface of the metal substrate. Specifically, when the chemical conversion treatment agent of the present invention is brought into contact with the metal substrate, a dissolution reaction of the metal substrate occurs. The metal ions eluted from the metal substrate extract fluorine from fluoride ions ($ZrF_6^{2-}$ and/or $TiF_6^{2-}$ and/or $HfF_6^{2-}$) of zirconium or the like, and the pH on the surface of the metal substrate increases. Consequently, a hydroxide (Zr—OH) or an oxide (Zr—O—) of zirconium or the like is deposited on the surface of the metal substrate. Then, the deposition of the hydroxide or oxide of the metal element on the surface of the metal substrate results in the formation of a chemical conversion coating film containing the metal element on the surface of the metal substrate. In addition, the co-condensate of the silane coupling agent (A) and the silane coupling agent (B) is coprecipitated and incorporated into the thus formed chemical conversion coating film during the formation of the chemical conversion coating film, and thus an inorganic-organic hybrid chemical conversion coating film is formed.

Reasons why the thus formed chemical conversion coating film serving as an underlayer of a coat film improves the adhesion of a coat film are presumably as follows: silanol groups adsorb onto the surface of the metal substrate by hydrogen bonding; and the amino group originated from the silane coupling agent (A) or the silane coupling agent (B) enhances the adhesion with the coat film. Moreover, since the constituent moiety originated from the silane coupling agent (B) has a sufficiently high hydrophobicity in the co-condensate of the silane coupling agent (A) and the silane coupling agent (B), the chemical conversion coating film into which the co-condensate is incorporated has a sufficiently high surface hydrophobicity. Hence, when a coating material is applied onto the chemical conversion-treated metal substrate, flowability of the coating material is improved at the baking of the coating material. Presumably because of this, the adhesion between the metal substrate and the coat film formed as an upper layer on the chemical conversion coating film is further improved.

A method for producing the chemical conversion treatment agent of the present invention is not particularly limited, and, for example, the following method may be employed. Specifically, a mixture of the silane coupling agent (A) and the silane coupling agent (B) is added to a water bath, and a co-condensate thereof is formed. Thus, a mixture liquid containing the co-condensate is obtained. Then, a compound containing the metal element (for example, zirconium fluoride or the like) serving as a source of the metal element and a fluorine-containing compound (for example, sodium fluoride) serving as a source of the fluorine element are introduced into the mixture liquid. Then, if necessary, a source of the metal element (B) (the compound of the metal element (B)), the surfactant, the pH adjusting agent, and the like are introduced into the mixture liquid. Then, these materials are mixed to form the chemical conversion treatment agent. Note that the order of the addition of the source of the metal element, the source of the fluorine element, the source of the metal element (B), the surfactant, and the pH adjusting agent is not particularly limited, and the order may be changed, as appropriate, depending on the design of the chemical conversion treatment agent and the like. Alternatively, these materials may be added simultaneously. In addition, temperature conditions and conditions of the atmosphere at the mixing of the source of the metal element, the source of the fluorine element, and the like with the mixture liquid are not particularly limited, and, for example, conditions of atmospheric pressure and normal temperature may be employed.

Hereinabove, the chemical conversion treatment agent of the present invention is described. Next, a method for surface treatment of a metal substrate of the present invention is described.

The method for surface treatment of a metal substrate of the present invention is a method comprising bringing the chemical conversion treatment agent of the present invention into contact with a surface of a metal substrate, to thereby form a chemical conversion coating film on the surface of the metal substrate.

A method for bringing the chemical conversion treatment agent into contact with the surface of the metal substrate is not particularly limited, and a known method can be employed as appropriate. For example, an immersion method, a spray method, a roll coating method, a flow application treatment method, or the like may be employed. Moreover, in the method for surface treatment of a metal substrate of the present invention, a method in which an electrolysis treatment is conducted by using the metal substrate as a cathode may be employed as the method for bringing the chemical conversion treatment agent into contact with the surface of the metal substrate. When such a method of an electrolysis treatment is employed, a reduction reaction of hydrogen occurs at a boundary of the metal substrate serving as the cathode, and the pH increases. With the increase of pH, an oxide of at least one metal element selected from the group consisting of zirconium, titanium, and hafnium or a hydroxide thereof containing water is deposited as a chemical conversion coating film on the surface of the metal substrate.

In addition, the temperature condition at which the chemical conversion treatment agent is brought into contact with the surface of the metal substrate is not particularly limited, and is preferably 20° C. to 70° C., and more preferably 30° C. to 50° C. If the temperature condition is lower than the lower limit, not only the formation of the chemical conversion coating film tends to be insufficient, but also workability and economical efficiency tend to deteriorate, because temperature adjustment is necessary when the temperature of the surrounding atmosphere is at or higher than the lower limit in the summer or the like. In addition, if the temperature condition exceeds the upper limit, the economical efficiency tends to deteriorate, because any further particular effect cannot be obtained.

In addition, the time for which the chemical conversion treatment agent is kept in contact with the surface of the metal substrate (the treatment time in the surface treatment) is preferably 2 to 1100 seconds, and more preferably 3 to 120 seconds. If the time is less than the lower limit, the chemical conversion coating film tends to be formed with an insufficient coated amount. Meanwhile, if the time exceeds the upper limit, economical efficiency tends to deteriorate, because any further effect is difficult to obtain.

Moreover, the metal substrate is not particularly limited, and a known metal substrate can be used as appropriate. Examples of the metal substrate include iron-based substrates (substrates made of iron-based metal materials), aluminum-based substrates (substrates made of aluminum-based metal materials), zinc-based substrates (substrates made of zinc-based metal materials), magnesium-based substrates (substrates made of magnesium-based metal materials), and the like. Here, the iron-based substrates mean metal substrates made of iron and/or an alloy thereof; the aluminum-based substrates mean metal substrates made of aluminum and/or an alloy thereof; the zinc-based substrates mean metal substrates made of zinc and/or an alloy thereof; and the magnesium-based substrates mean metal substrates made of magnesium and/or an alloy thereof.

Moreover, the metal substrate may be made of multiple metal materials such as iron-based, aluminum-based, and zinc-based metal materials. In particular, automobile bodies, automobile parts, and the like are made of various metal materials such as iron, zinc and aluminum. Even on such metal substrates made of multiple metal materials, the method for surface treatment of a metal substrate of the present invention makes it possible to form a chemical conversion coating film having a sufficient original surface-hiding performance and adhesion, and also to impart a sufficiently high corrosion resistance.

In addition, the iron-based substrates used as the metal substrate are not particularly limited. Examples of the iron-based substrates include cold-rolled steel plates, hot-rolled steel plates, high-tensile steel plates, and the like. In addition, the aluminum-based substrates used as the metal substrate are not particularly limited. Examples of the aluminum-based substrates include 5000 series aluminum alloys, 6000 series aluminum alloys, aluminum-plated steel plates obtained by aluminum-based electroplating, hot dip coating, deposition plating, or the like, etc. In addition, the zinc-based substrates used as the metal substrate are not particularly limited. Examples of the zinc-based substrates include zinc- or zinc-based alloy-plated steel plates such as zinc-based electroplated, hot-dip-coated, or deposition-plated steel plates including zinc-plated steel plates, zinc-nickel-plated steel plates, zinc-iron-plated steel plates, zinc-chromium-plated steel plates, zinc-aluminum-plated steel plates, zinc-titanium-plated steel plates, zinc-magnesium-plated steel plates, zinc-manganese-plated steel plates, and the like, etc. Moreover, the high-tensile steel plates exist in various grades according to the strength and the production method, and are not particularly limited. Examples of the high-tensile steel plates include JSC440J, 440P, 440W, 590R, 590T, 590Y, 780T, 780Y, 980Y, 1180Y, and the like.

Moreover, the method for surface treatment of a metal substrate of the present invention preferably comprises, as a pretreatment step, a step of performing a degreasing treatment on the metal substrate in advance. In addition, the method for surface treatment of a metal substrate of the present invention preferably further comprises, after the degreasing treatment is performed on the metal substrate in advance, a step of performing a water-washing treatment on the metal substrate. The degreasing treatment and the water-washing treatment are performed for removing oil components and stains adhered to the surface of the metal substrate. In the degreasing treatment, a known method can be employed as appropriate. For example, it is possible to employ a method in which an immersion treatment is performed in a degreasing agent such as a nitrogen-free degreasing washing liquid under conditions of phosphorus free and a temperature of about 30° C. to 55° C. for about several minutes, or the like. Moreover, optionally, a preliminary degreasing treatment step may further be performed before the degreasing treatment step. In addition, the water-washing treatment following to the degreasing treatment is performed for rinsing the degreasing agent with water. For this reason, in the water-washing treatment, it is preferable to employ a method in which washing is performed at least once or more with a large amount of washing water. As a method for supplying the washing water, a method may be employed in which the washing water is supplied by a spray treatment. Note that when the chemical conversion treatment agent of the present invention comprises a surfactant as described above, the chemical conversion coating film tends to be formed in a sufficiently efficient manner even without the cleaning of the metal substrate by the degreasing treatment in advance, because a degreasing treatment on the metal substrate is performed by the surfactant simultaneously with the film formation, upon contact with the chemical conversion treatment agent.

In addition, when the metal substrate is a metal substrate of an iron-based metal material, such as a cold-rolled steel plate, a hot-rolled steel plate, cast iron or a sintered material, or when the metal substrate is a metal substrate of a zinc-based metal material such as a zinc or zinc-plated steel plate or an alloyed hot-dip zinc-plated steel plate, the following chemical conversion coating film is preferable as the chemical conversion coating film formed on the surface of the metal substrate as described above, from the viewpoints of enhancing the corrosion resistance more sufficiently, forming a more uniform surface treatment coating film, and obtaining a good adhesion. Specifically the chemical conversion coating film preferably contains 10 $mg/m^2$ or more (more preferably 20 $mg/m^2$ or more, and further preferably 30 $mg/m^2$ or more) of the at least one metal element selected from the group consisting of zirconium, titanium, and hafnium in terms of the metal element, and 0.5 $mg/m^2$ or more (more preferably 1 $mg/m^2$ or more and further preferably 1.5 $mg/m^2$ or more) of silicon element in terms of the metal element. Meanwhile, when the metal substrate is a metal substrate of an aluminum-based metal material, such as an aluminum cast or an aluminum alloy plate, or when the metal substrate is a metal substrate of a magnesium-based metal material, such as a magnesium alloy plate or a magnesium cast, the following chemical conversion coating film is preferable as the chemical conversion coating film of the chemical conversion treatment from the same viewpoints. Specifically, the chemical conversion coating film preferably contains 5 $mg/m^2$ or more (more preferably 10 mg/m$^2$ or more) of the at least one metal element selected from the group consisting of zirconium, titanium, and hafnium in terms of the metal element, and 0.5 mg/m$^2$ or more (more preferably 1 mg/m$^2$ or more) of the silicon element in terms of the metal element.

In addition, even in a case where the metal substrate is a metal substrate of any metal material, an upper limit of a content (coated amount) of each element in the chemical conversion coating film formed by the chemical conversion treatment is not particularly limited. However, if the chemical conversion-coated amount is too large, the possibility of the formation of cracks in a surface treatment coating film layer increases, so that it is difficult to obtain a good chemical conversion coating film, in some cases. From such a viewpoint, the content of the at least one metal element selected from the group consisting of zirconium, titanium, and hafnium in the chemical conversion coating film is preferably 1 g/m$^2$ or less, and more preferably 800 mg/m$^2$ or less, in terms of the metal element.

Moreover, even in a case where the metal substrate is a metal substrate of any metal material, a mass ratio ([mass of metal element]/[mass of silicon]), in terms of element, of the at least one metal element selected from the group consisting of zirconium, titanium, and hafnium to the silicon element in the chemical conversion coating film is preferably 0.5 to 100. If the mass ratio is lower than 0.5, it tends to be impossible to obtain corrosion resistance and adhesion. Meanwhile, if the mass ratio exceeds 100, the possibility of the formation of cracks in the chemical conversion coating film formed by the surface treatment increases. Note that the mass ratio of the silicon element in the chemical conversion coating film can be determined by measuring a content ratio between elements in the chemical conversion coating film by using an X-ray fluorescence analyzer (for example, one manufactured by Shimadzu Corporation under the trade name of "XRF1700" or the like).

In addition, in the present invention, it is preferable to perform a treatment (hereinafter, referred to as "coating-film water-washing treatment" in some cases) of washing the chemical conversion coating film with water, after the formation of the chemical conversion coating film on the surface of the metal substrate by bringing the chemical conversion treatment agent of the present invention into contact with the surface of the metal substrate. By performing the water-washing treatment on the chemical conversion coating film before formation of a coat film as described above, the chemical conversion treatment agent remaining on the surface of the chemical conversion coating film is removed, and the adhesion with the coated coat film is further improved, so that a sufficiently high corrosion resistance tends to be imparted. In addition, the co-condensate of the silane coupling agents (A) and (B) is incorporated into the chemical conversion coating film thus formed on the surface of the metal substrate as described above, and the co-condensate strongly interacts with a hydroxide or an oxide of the metal element (A) forming the chemical conversion coating film. Hence, even when the coating-film water-washing treatment is performed before the formation of a coat film, the chemical conversion coating film is not removed, and the coat film adhesion is not impaired. For this reason, in the present invention, the coating-film water-washing treatment in which the chemical conversion coating film formed on the surface of the metal substrate is washed with water can be preferably employed before the formation of the coat film. By performing the water-washing treatment on the chemical conversion coating film, components which are originated from the chemical conversion treatment agent, and which are not incorporated into the chemical conversion coating film, but adhered to the surface of the chemical conversion coating film can be removed. Thus, carry-over of the components to the subsequent coating step can be prevented. A chemical conversion coating film can be formed on a surface of a metal substrate by the chemical conversion reaction as described above. Hence, even when the metal substrate is a complex-shaped article (for example, an automobile body or part) having a curved surface or a pocket portion, a chemical conversion coating film uniform in film thickness and components all over the chemical conversion coating film can be formed on the surface of the metal substrate, and a good coat film adhesion can be obtained all over the chemical conversion coating film.

In the coating-film water-washing treatment, the final washing with water is preferably performed with pure water. A method for the water-washing treatment on the chemical conversion coating film is not particularly limited, and may be any of spray washing with water or immersion washing with water, or may be a combination thereof. In addition, after such a water-washing treatment is performed on the chemical conversion coating film, a drying treatment may be performed by a known method, if necessary.

In addition, when a chemical conversion coating film is formed on a surface of a metal substrate by the surface treatment method of the present invention, a coating treatment may be performed directly on the metal substrate after the coating-film water-washing treatment, without any drying treatment. Specifically, when a chemical conversion coating film is formed on a surface of a metal substrate by the surface treatment method of the present invention, a wet-on-wet coating method can be employed as a method for applying a coating material to the metal substrate. For this reason, when the method for surface treatment of a metal substrate of the present invention is used as a pretreatment in the formation of a coat film by electrodeposition, which is a wet process, the chemical conversion coating film in a wet state after the formation thereof or after the additional washing with water can be used in the electrodeposition, so that a drying step before the coating can be omitted. The surface treatment method of the present invention can be applied to outer panels of vehicles such as automobile bodies and two-wheel vehicle bodies, various parts, and the like.

Moreover, in the present invention, after the formation of the chemical conversion coating film on the surface of the metal substrate by bringing the chemical conversion treatment agent of the present invention into contact with the surface of the metal substrate, the metal substrate on which the coating film is formed may be brought into contact with an acidic aqueous solution comprising at least one selected from the group consisting of cobalt, nickel, tin, copper, titanium, and zirconium. The contact step with such an acidic aqueous solution is preferably performed after the above-described water-washing treatment on the chemical conversion coating film. The contact step with such an acidic aqueous solution makes it possible to further improve the corrosion resistance.

The source of the at least one selected from the group consisting of cobalt, nickel, tin, copper, titanium, and zirconium contained in the acidic aqueous solution is not particularly limited. It is preferable to use any of oxides, hydroxides, chlorides, nitrates, oxynitrates, sulfates, oxysulfates, carbonates, oxycarbonates, phosphates, oxyphosphates, oxalates, oxyoxalates, organometallic compounds, and the like of these elements which are readily available.

In addition, the value of pH of the acidic aqueous solution is preferably set to 2 to 6. The value of pH of the acidic aqueous solution can be adjusted with an acid such as phosphoric acid, nitric acid, sulfuric acid, hydrofluoric acid, hydrochloric acid, or an organic acid, or an alkali such as sodium hydroxide, potassium hydroxide, lithium hydroxide, an alkali metal salt, ammonia, an ammonium salt, or amines.

Moreover, in the present invention, after the formation of the chemical conversion coating film on the surface of the metal substrate by bringing the chemical conversion treatment agent of the present invention into contact with the surface of the metal substrate, the metal substrate on which the chemical conversion coating film is formed may be brought into contact with a polymer-containing liquid comprising at least one of water-soluble polymer compounds and water-dispersible polymer compounds. The contact step with such a polymer-containing liquid is preferably performed after the above-described water-washing treatment on the chemical conversion coating film. The contact step with such an acidic aqueous solution makes it possible to further improve the corrosion resistance. The water-soluble polymer compounds and the water-dispersible polymer compounds are not particularly limited, and examples thereof include polyvinyl alcohol, poly(meth)acrylic acid, a copolymer of acrylic acid with methacrylic acid, copolymers of ethylene with an acrylic monomer such as (meth)acrylic acid or a (meth)acrylate, a copolymer of ethylene with vinyl acetate, polyurethanes, amino-modified phenolic resins, polyester resins, epoxy resins, tannins, tannic acids, salt thereof, and phytic acid.

Moreover, the method for surface treatment of a metal substrate of the present invention makes it possible to form a chemical conversion coating film having a sufficiently high adhesion with a coat film to be formed as an upper layer on the surface of the metal substrate. For this reason, after formation of such a chemical conversion coating film, a coat film is preferably formed. The coat film is not particularly limited, and examples thereof include coat films formed from conventionally known coating materials such as electrodeposition coating materials, solvent-borne coating materials, water-borne coating materials, powder coating materials, and the like. In addition, the step of forming such a coat film is not particularly limited, and a known method can be employed, as appropriate. As described above, the method for surface treatment of a metal substrate of the present invention can be preferably used as a chemical conversion treatment in the formation of a coat film on the surface of the metal substrate.

In addition, when the coat film is formed as described above, the coat film is preferably formed by using, among the above-described coating materials, an electrodeposition coating material, especially a cationic electrodeposition coating material, because of the following reason. Specifically, such a cationic electrodeposition coating material is made of a resin having a functional group reactive or mutually soluble with an amino group, in general. Hence, the adhesion between the electrodeposition coat film and the chemical conversion coating film can be further enhanced by the interaction between the coat film as the upper layer and an amino group originated from the silane coupling agent (A) or the silane coupling agent (B) contained in the chemical conversion coating film formed from the chemical conversion treatment agent of the present invention. The cationic electrodeposition coating material is not particularly limited, and examples thereof include known cationic electrodeposition coating materials made of aminated epoxy resins, aminated acrylic resins, sulfonium-modified epoxy resins, or the like.

EXAMPLES

Hereinafter, the present invention will be described more specifically based on Examples and Comparative Examples. However, the present invention is not limited to Examples below.

Example 1

Preparation of Co-Condensate of Silane Coupling Agents (A) and (B)

For preparation of a co-condensate of a silane coupling agent (A) and a silane coupling agent (B), first, N-(2-aminoethyl)-3-aminopropyl-trimethoxysilane (manufactured by Shin-Etsu Chemical Co., Ltd. under the trade name of "KBM603," effective concentration: 100%) was prepared as the silane coupling agent (A), and 2-(3,4-epoxycyclohexyl)ethyltrimethoxysilane (manufactured by Shin-Etsu Chemical Co., Ltd. under the trade name of "KBM303", effective concentration: 100%) was prepared as the silane coupling agent (B). Then, a mixture was obtained by mixing the silane coupling agent (A) and the silane coupling agent (B) in a mass ratio ((A):(B)) of the silane coupling agent (A) to the silane coupling agent (B) of 8:2. Subsequently, 5 parts by mass of the mixture in a dropping funnel was uniformly added dropwise to 95 parts by mass of deionized water (at a temperature of 25° C.) over 60 minutes. Thus, a reaction liquid was obtained (pH: 10.5). After that, the silane coupling agent (A) and the silane coupling agent (B) were polymerized in the reaction liquid by stirring the reaction liquid for 24 hours under conditions of a nitrogen atmosphere and 25° C. Thus, a mixture liquid was obtained which contained a co-condensate of the silane coupling agent (A) and the silane coupling agent (B), with active components being 5% by mass. Here, the active components refer to non-volatile components. The mixture liquid containing the co-condensate of the silane coupling agent (A) and the silane coupling agent (B) was subjected to $^{29}$Si-NMR measurement by using FT-NMR (AVANCE 400 (400 MHz), manufactured by Bruker) to determine the condensation ratio. As a result, the condensation ratio was 90%.

<Production of Chemical Conversion Treatment Agent>

The mixture liquid containing the co-condensate obtained as described above, fluorozirconic acid, acidic sodium fluoride, and aluminum nitrate were mixed with each other. Here, the resultant content of zirconium element was 250 ppm in terms of the element; the resultant total content of the silane coupling agent (A) and the silane coupling agent (B) (including the co-condensate) was 500 ppm based on the amount of solid components; the resultant content of fluorine element was 522.5 ppm in terms of the element; the resultant concentration of free fluorine ions was 10 ppm, as measured by a meter having a fluorine ion electrode; and the resultant content of aluminum was 100 ppm in terms of the element. The value of pH was adjusted to 4 by further adding an aqueous sodium hydroxide solution. Thus, a chemical conversion treatment agent was obtained. Table 1 shows the concentration of each element in the chemical conversion treatment agent, the pH of the chemical conversion treatment agent, and the like.

<Surface Treatment of Metal Substrate>

First, a commercially available cold-rolled steel plate (SPC, manufactured by Nippon Testpanel Co., Ltd, 70 mm in length, 150 mm in width, and 0.8 mm in thickness) was prepared as a metal substrate. Note that the metal substrate was subjected to a degreasing treatment and a water-washing treatment in advance. In the degreasing treatment, a method was employed in which the surface of the metal substrate was treated at 40° C. for 2 minutes by using "SURFCLEANER EC92" (manufactured by Nippon Paint Co., Ltd) as an alkaline degreasing treatment agent. Meanwhile, in the water-washing treatment, a method was employed in which the metal substrate was washed by immersion in a washing tank, and then spraying with tap water for approximately 30 seconds.

Next, by using the chemical conversion treatment agent obtained as described above, a chemical conversion treatment was performed on the surface of the metal substrate under chemical conversion treatment conditions shown in Table 1. Specifically, the temperature of the chemical conversion treatment agent was adjusted to 42° C., and the metal substrate was subjected to an immersion treatment in the chemical conversion treatment agent for 90 seconds. Thus, a chemical conversion coating film was formed on the surface of the metal substrate. Table 1 shows the conditions in the chemical conversion treatment.

Examples 2 to 5

Mixture liquids each containing a co-condensate of the silane coupling agents (A) and (B) and chemical conversion treatment agents were produced in the same manner as in Example 1, except that the value of pHs of the reaction liquid were set to 7 (Example 2), 5 (Example 3), 3 (Example 4), and 1 (Example 5), respectively, in the preparation of the co-condensate of the silane coupling agents (A) and (B). The condensation ratios of the mixtures were all 60% or higher. Table 1 shows the concentration of each element in each of the chemical conversion treatment agents, the pH of the chemical conversion treatment agent, and the like.

In addition, surface treatments were performed on metal substrates by employing the same method as in Example 1, except that the thus obtained chemical conversion treatment agents were used instead of the chemical conversion treatment agent used in Example 1, respectively. Thus, chemical conversion coating films were formed on the surfaces of the metal substrates. Table 1 shows the conditions in the chemical conversion treatments.

Examples 6 to 8

Mixture liquids each containing a co-condensate of the silane coupling agents (A) and (B) and chemical conversion treatment agents were produced in the same manner as in Example 1, except that the mass ratios ((A):(B)) of the silane coupling agent (A) to the silane coupling agent (B) were set to 5:5 (Example 6), 7:3 (Example 7), and 9:1 (Example 8), respectively, in the preparation of the co-condensates of the silane coupling agents (A) and (B), and that the values of pH of the reaction liquids were all set to 3 in the preparation of the co-condensates of the silane coupling agents (A) and (B). The condensation ratios of the mixture liquids were all 60% or higher. Table 1 shows the concentration of each element in each of the chemical conversion treatment agents, the pH of the chemical conversion treatment agent, and the like.

In addition, surface treatments were performed on metal substrates by employing the same method as in Example 1, except that the thus obtained chemical conversion treatment agents were used instead of the chemical conversion treatment agent used in Example 1, respectively. Thus, chemical conversion coating films were formed on the surfaces of the metal substrates. Table 1 shows the conditions in the chemical conversion treatment.

Example 9

A mixture liquid containing a co-condensate of silane coupling agents (A) and (B) and a chemical conversion treatment agent were produced in the same manner as in Example 1, except that phenoxytrimethoxysilane (manufactured by Shin-Etsu Chemical Co., Ltd. under the trade name of "KBM103", effective concentration: 100%) was used as the silane coupling agent (B) instead of 2-(3,4-epoxycyclohexyl)ethyltrimethoxysilane (manufactured by Shin-Etsu Chemical Co., Ltd. under the trade name of "KBM303"), and that the value of pH of the reaction liquid was set to 3 in the preparation of the co-condensate of the silane coupling agents (A) and (B). The condensation ratio of the mixture liquid was 60% or higher. Table 1 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment.

Example 10

A mixture liquid containing a co-condensate of silane coupling agents (A) and (B) and a chemical conversion treatment agent were produced in the same manner as in Example 1, except that 3-aminopropyltrimethoxysilane (manufactured by Shin-Etsu Chemical Co., Ltd. under the trade name of "KBM903", effective concentration: 100%) was used as the silane coupling agent (A) instead of N-(2-aminoethyl)-3-aminopropyl-trimethoxysilane (manufactured by Shin-Etsu Chemical Co., Ltd. under the trade name of "KBM603"), that phenoxytrimethoxysilane (manufactured by Shin-Etsu Chemical Co., Ltd. under the trade name of "KBM103", effective concentration: 100%) was used as the silane coupling agent (B) instead of 2-(3,4-epoxycyclohexyl)ethyltrimethoxysilane (manufactured by Shin-Etsu Chemical Co., Ltd. under the trade name of "KBM303"), and that each value of pH of the reaction liquid was set to 3 in the preparation of the co-condensate of the silane coupling agents (A) and (B). The condensation ratio of the mixture liquid was 60% or higher. Table 1 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment.

Example 11

A mixture liquid containing a co-condensate of silane coupling agents (A) and (B) and a chemical conversion treatment agent were produced in the same manner as in Example 1, except that 3-aminopropyltrimethoxysilane (manufactured by Shin-Etsu Chemical Co., Ltd. under the trade name of "KBM903", effective concentration: 100%) was used as the silane coupling agent (A) instead of N-(2-aminoethyl)-3-aminopropyl-trimethoxysilane (manufactured by Shin-Etsu Chemical Co., Ltd. under the trade name of "KBM603"), and that the value of pH of the reaction liquid was set to 3 in the preparation of the co-condensate of the silane coupling agents (A) and (B). The condensation ratio of the mixture liquid was 60% or higher. Table 1 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment.

Example 12

A mixture liquid containing a co-condensate of the silane coupling agents (A) and (B) and a chemical conversion treatment agent were produced in the same manner as in Example 1, except that each value of pH of the reaction liquid was set to 3 in the preparation of the co-condensate of the silane coupling agents (A) and (B), and that tin sulfate was further added and mixed in the production of the chemical conversion treatment agent, with the resultant content of tin element being 20 ppm. The condensation ratio of the mixture liquid was 60% or higher. Table 1 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment.

Example 13

A mixture liquid containing a co-condensate of the silane coupling agents (A) and (B) and a chemical conversion treatment agent were produced in the same manner as in Example 1, except that the value of pH of the reaction liquid was set to 3 in the preparation of the co-condensate of the silane coupling agents (A) and (B), and that tin sulfate and magnesium nitrate were further added and mixed in the production of the chemical conversion treatment agent, with the resultant content of tin element being 20 ppm and the resultant content of magnesium element being 1000 ppm. The condensation ratio of the mixture liquid was 60% or higher. Table 1 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment.

Example 14

The chemical conversion treatment agent which was obtained in Example 4 but left for 5 hours was employed as the chemical conversion treatment agent. A surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment, and the like.

Example 15

The chemical conversion treatment agent which was obtained in Example 4 but stored for 3 months was employed as the chemical conversion treatment agent. A surface treatment was performed on a metal substrate by employing the same method as in Example 1, except that the thus obtained chemical conversion treatment agent was used. Thus, a chemical conversion coating film was formed on the surface of the metal substrate. Table 1 shows the conditions in the chemical conversion treatment, and the like.

Example 16 to Example 21

Chemical conversion treatment agents were prepared in the same manner as in Example 4, except that the content of each element in each of the chemical conversion treatment agents was set as shown in Table 1. Then, surface treatments were performed on metal substrates by employing the same method as in Example 4, except that the thus obtained chemical conversion treatment agents were used. Thus, chemical conversion coating films were formed on the surfaces of the metal substrates. Table 1 shows the conditions in the chemical conversion treatments.

TABLE 1

| | Content (ppm) of each element in chemical conversion treatment agent | | | | | | pH value of chemical conversion treatment agent | Kinds of silane coupling agents | | Mass ratio [(A)/(B)] of silane coupling agents | pH value of reaction solution at condensation | Chemical conversion treatment conditions | |
|---|---|---|---|---|---|---|---|---|---|---|---|---|---|
| | Zr | Al | F | Free F ions | Other elements | Total of silane coupling agents (A) and (B) (including co-condensate) | | (A) | (B) | | | Temperature (° C.) | Time (Second) |
| Example 1 | 250 | 100 | 522.5 | 10 | — | 500 | 4 | KBM 603 | KBM 303 | 8/2 | 10.5 | 42 | 90 |
| Example 2 | 250 | 100 | 522.5 | 10 | — | 500 | 4 | KBM 603 | KBM 303 | 8/2 | 7 | 42 | 90 |

TABLE 1-continued

| | Content (ppm) of each element in chemical conversion treatment agent | | | | | | pH | | | | pH value | Chemical | |
|---|---|---|---|---|---|---|---|---|---|---|---|---|---|
| | | | | Free | | Total of silane coupling agents (A) and (B) | value of chemical conversion | Kinds of silane | | Mass ratio [(A)/(B)] of silane | of reaction solution | conversion treatment conditions | |
| | | | | F | Other | (including co- | treatment | coupling agents | | coupling | at | Temperature | Time |
| | Zr | Al | F | ions | elements | condensate) | agent | (A) | (B) | agents | condensation | (° C.) | (Second) |
| Example 3 | 250 | 100 | 522.5 | 10 | — | 500 | 4 | KBM 603 | KBM 303 | 8/2 | 5 | 42 | 90 |
| Example 4 | 250 | 100 | 522.5 | 10 | — | 500 | 4 | KBM 603 | KBM 303 | 8/2 | 3 | 42 | 90 |
| Example 5 | 250 | 100 | 522.5 | 10 | — | 500 | 4 | KBM 603 | KBM 303 | 8/2 | 1 | 42 | 90 |
| Example 6 | 250 | 100 | 522.5 | 10 | — | 500 | 4 | KBM 603 | KBM 303 | 5/5 | 3 | 42 | 90 |
| Example 7 | 250 | 100 | 522.5 | 10 | — | 500 | 4 | KBM 603 | KBM 303 | 7/3 | 3 | 42 | 90 |
| Example 8 | 250 | 100 | 522.5 | 10 | — | 500 | 4 | KBM 603 | KBM 303 | 9/1 | 3 | 42 | 90 |
| Example 9 | 250 | 100 | 522.5 | 10 | — | 500 | 4 | KBM 603 | KBM 103 | 8/2 | 3 | 42 | 90 |
| Example 10 | 250 | 100 | 522.5 | 10 | — | 500 | 4 | KBM 903 | KBM 103 | 8/2 | 3 | 42 | 90 |
| Example 11 | 250 | 100 | 522.5 | 10 | — | 500 | 4 | KBM 903 | KBM 303 | 8/2 | 3 | 42 | 90 |
| Example 12 | 250 | 100 | 522.5 | 10 | Sn: 20 | 500 | 4 | KBM 603 | KBM 303 | 8/2 | 3 | 42 | 90 |
| Example 13 | 250 | 100 | 522.5 | 5 | Mg: 1000, Sn: 20 | 500 | 4 | KBM 603 | KBM 303 | 8/2 | 3 | 42 | 90 |
| Example 14 | 250 | 100 | 522.5 | 10 | — | 500 | 4 | KBM 603 | KBM 303 | 8/2 | 3 | 42 | 90 |
| Example 15 | 250 | 100 | 522.5 | 10 | — | 500 | 4 | KBM 603 | KBM 303 | 8/2 | 3 | 42 | 90 |
| Example 16 | 1000 | 100 | 522.5 | 12 | | 500 | 4 | KBM 603 | KBM 303 | 8/2 | 3 | 42 | 90 |
| Example 17 | 100 | 100 | 522.5 | 10 | | 500 | 4 | KBM 603 | KBM 303 | 8/2 | 3 | 42 | 90 |
| Example 18 | 250 | 100 | 550 | 20 | | 500 | 4 | KBM 603 | KBM 303 | 8/2 | 3 | 42 | 90 |
| Example 19 | 250 | 100 | 500 | 5 | | 500 | 4 | KBM 603 | KBM 303 | 8/2 | 3 | 42 | 90 |
| Example 20 | 250 | 100 | 522.5 | 10 | | 200 | 4 | KBM 603 | KBM 303 | 8/2 | 3 | 42 | 90 |
| Example 21 | 250 | 100 | 522.5 | 10 | | 1000 | 4 | KBM 603 | KBM 303 | 8/2 | 3 | 42 | 90 |

Comparative Example 1

First, a mixture liquid containing a condensate of the silane coupling agent (A) was produced in the same manner as in Example 1, except that only the silane coupling agent (A) was used instead of the mixture obtained by mixing the silane coupling agent (A) and the silane coupling agent (B) in the preparation of the co-condensate of the silane coupling agents (A) and (B). The condensation ratio of the mixture liquid was 60% or higher. Next, a chemical conversion treatment agent was produced in the same manner as in Example 1, except that the mixture liquid containing the condensate of the silane coupling agent (A) was used instead of the mixture liquid containing the co-condensate of the silane coupling agent (A) and the silane coupling agent (B). Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 2

A chemical conversion treatment agent was produced in the same manner as in Comparative Example 1, except that tin sulfate was further added and mixed in the production of the chemical conversion treatment agent, with the resultant content of tin element being 20 ppm. Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 3

A chemical conversion treatment agent was produced in the same manner as in Comparative Example 1, except that tin sulfate and magnesium nitrate were further added and mixed in the production of the chemical conversion treatment agent, with the resultant content of tin element being 20 ppm and the resultant content of magnesium element being 1000 ppm. Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 4

First, a mixture liquid containing a condensate of the silane coupling agent (B) was produced in the same manner as in Example 4, except that only the silane coupling agent (B) was used instead of the mixture obtained by mixing the silane coupling agent (A) and the silane coupling agent (B) in the preparation of the co-condensate of the silane coupling agents (A) and (B). The condensation ratio of the mixture liquid was 60% or higher. Next, a chemical conversion treatment agent was produced in the same manner as in Example 1, except that the mixture liquid containing the condensate of the silane coupling agent (B) was used instead of the mixture liquid containing the co-condensate of the silane coupling agent (A) and the silane coupling agent (B). Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 5

A mixture liquid containing a condensate of a silane coupling agent (B) and a chemical conversion treatment agent were produced in the same manner as in Comparative Example 4, except that phenoxytrimethoxysilane (manufactured by Shin-Etsu Chemical Co., Ltd. under the trade name of "KBM103", effective concentration: 100%) was used as the silane coupling agent (B) instead of 2-(3,4-epoxycyclohexyl)ethyltrimethoxysilane (manufactured by Shin-Etsu Chemical Co., Ltd. under the trade name of "KBM303"). The condensation ratio of the mixture liquid was 60% or higher. Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 6

A mixture liquid containing a co-condensate of silane coupling agents (A) and (B) and a chemical conversion treatment agent were produced in the same manner as in Example 4, except that 3-glycidoxypropylmethoxysilane (manufactured by Shin-Etsu Chemical Co., Ltd. under the trade name of "KBM403", effective concentration: 100%) was used as the silane coupling agent (B) instead of 2-(3,4-epoxycyclohexyl)ethyltrimethoxysilane (manufactured by Shin-Etsu Chemical Co., Ltd. under the trade name of "KBM303"). The condensation ratio of the mixture liquid was 60% or higher. Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 7

A mixture liquid containing a co-condensate of silane coupling agents (A) and (B) and a chemical conversion treatment agent were produced in the same manner as in Example 4, except that tetraethoxysilane (manufactured by Shin-Etsu Chemical Co., Ltd. under the trade name of "KBE04", effective concentration: 100%) was used as the silane coupling agent (B) instead of 2-(3,4-epoxycyclohexyl)ethyltrimethoxysilane (manufactured by Shin-Etsu Chemical Co., Ltd. under the trade name of "KBM303"), and that the mass ratio ((A):(B)) of the silane coupling agent (A) to the silane coupling agent (B) was set to 5:5 in the preparation of the co-condensate of the silane coupling agents (A) and (B). The condensation ratio of the mixture liquid was 60% or higher. Table 2 shows the concentration of each element in the thus obtained chemical conversion treatment agent, the pH of the chemical conversion treatment agent, and the like.

In addition, a surface treatment was performed on a metal substrate by employing the same method as in Example 1, except that the thus obtained chemical conversion treatment agent was used. Thus, a chemical conversion coating film was formed on the surface of the metal substrate. Table 2 shows the conditions in the chemical conversion treatment.

Comparative Example 8

The chemical conversion treatment agent which was obtained in Comparative Example 1 but left for 5 hours was employed as the chemical conversion treatment agent. A surface treatment was performed on a metal substrate by employing the same method as in Example 1, except that that the thus obtained chemical conversion treatment agent was used. Thus, a chemical conversion coating film was formed on the surface of the metal substrate. Table 2 shows the conditions in the chemical conversion treatment, and the like.

Comparative Example 9

A surface treatment was performed on a metal substrate by using a chemical conversion treatment agent (manufactured by Nippon Paint Co., Ltd under the trade name of "SURFDINE SD-6350") containing zinc phosphate as the chemical conversion treatment agent as follows. Specifically, first, a metal substrate which was the same as that used in Example 1, and was subjected to the degreasing treatment and the water-washing treatment was prepared, and the metal substrate was subjected to surface conditioning by immersion in a 0.3% by mass surface conditioner (manufactured by Nippon Paint Co., Ltd under the trade name of "SURFFINE GL1") at room temperature for 30 seconds. Subsequently, the surface-treated metal substrate was subjected to an immersion treatment in a chemical conversion treatment agent (manufactured by Nippon Paint Co., Ltd under the trade name of "SURFDINE SD-6350") containing zinc phosphate under a temperature condition of 42° C. for 2 minutes. Thus, a chemical conversion coating film was formed on the surface of the metal substrate.

TABLE 2

| | Content (ppm) of each element in chemical conversion treatment agent | | | | | | pH | | | | pH value | Chemical | |
|---|---|---|---|---|---|---|---|---|---|---|---|---|---|
| | | | | Free | | Total of silane coupling agents (A) and (B) | value of chemical conversion | Kinds of silane | | Mass ratio [(A)/(B)] of silane | of reaction solution | conversion treatment conditions | |
| | | | | F | Other | (including co- | treatment | coupling agents | | coupling | at | Temperature | Time |
| | Zr | Al | F | ions | elements | condensate) | agent | (A) | (B) | agents | condensation | (° C.) | (Second) |
| Comp. Ex. 1 | 250 | 100 | 522.5 | 10 | — | 500 | 4 | KBM 603 | — | — | 10.5 | 42 | 90 |
| Comp. Ex. 2 | 250 | 100 | 522.5 | 10 | Sn: 20 | 500 | 4 | KBM 603 | — | — | 10.5 | 42 | 90 |
| Comp. Ex. 3 | 250 | 100 | 522.5 | 5 | Mg: 1000, Sn: 20 | 500 | 4 | KBM 603 | — | — | 10.5 | 42 | 90 |
| Comp. Ex. 4 | 250 | 100 | 522.5 | 10 | — | 500 | 4 | — | KBM 303 | — | 3 | 42 | 90 |
| Comp. Ex. 5 | 250 | 100 | 522.5 | 10 | — | 500 | 4 | — | KBM 103 | — | 3 | 42 | 90 |
| Comp. Ex. 6 | 250 | 100 | 522.5 | 10 | — | 500 | 4 | KBM 603 | KBM 403 | 8/2 | 3 | 42 | 90 |
| Comp. Ex. 7 | 250 | 100 | 522.5 | 10 | — | 500 | 4 | KBM 603 | KBE 04 | 5/5 | 3 | 42 | 90 |
| Comp. Ex. 8 | 250 | 100 | 522.5 | 10 | — | 500 | 4 | KBM 603 | — | — | 10.5 | 42 | 90 |

[Evaluation of Characteristics of Chemical Conversion Coating Films Formed on Metal Substrates in Examples 1 to 21 and Comparative Examples 1 to 9]

<Measurement of Content (Coated Amount) of Each Element in Chemical Conversion Coating Films>

The chemical conversion-treated metal substrates obtained in Examples 1 to 21 and Comparative Examples 1 to 8 (the metal substrates on which the chemical conversion coating films were formed) were each subjected to a coating-film water-washing treatment and a drying treatment described below. Then, the content (mg/m$^2$) of each element of zirconium (Zr) and silicon (Si) in the coating film formed on each of the metal substrates was measured by using an X-ray fluorescence analyzer (manufactured by Shimadzu Corporation under the trade name of "XRF1700"). Note that, as the method for the water-washing treatment, a treatment method was employed in which the metal substrate was washed with water by a spray treatment with tap water for 30 seconds, and further washed with water by a spray treatment with ion-exchanged water for 10 seconds. As the method for the drying treatment, a method was employed in which, after the water-washing treatment, the metal substrate was introduced into an electric drying furnace, and dried under a temperature condition of 80° C. for 5 minutes. Table 3 shows the results.

<Secondary Adhesion Test (SDT)>

A sample substrate (I) and a sample substrate (II) were prepared by using each of the chemical conversion-treated metal substrates obtained in Examples 1 to 21 and Comparative Examples 1 to 9 (the metal substrates on which the chemical conversion coating films were formed) as shown below. Then, the secondary adhesion of each of coat films was measured. Specifically, first, an X-shaped cut (the angles formed by the two line in the "X": 30°, the length of each single line: 100 mm) was formed in each sample substrate, with the cut extending from a surface of the sample substrate to the original surface of the metal substrate. Next, each sample substrate in which the cut was formed was immersed in a 5% by mass aqueous NaCl solution under a temperature condition of 50° C. for 480 hours. Subsequently, after immersion in the aqueous NaCl solution, each sample substrate was washed with water, and dried with the air. An adhesive tape (manufactured by Nichiban Co., Ltd. under the trade name of "Lpack LP-24") was tightly attached to the cut potion, and then the adhesive tape was rapidly peeled off. Then, the magnitude of the maximum width of the coat film adhered to the each peeled adhesive tape was measured. Table 3 shows the results.

[Production of Sample Substrates (I)]

By using each of the chemical conversion-treated metal substrates obtained in Examples 1 to 21 and Comparative Examples 1 to 9 (the metal substrates on which the chemical conversion coating films were formed), an electrodeposition coat film was formed on the chemical conversion coating film of the metal substrate as shown below. Thus, each of the sample substrates (I) was produced. Specifically, first, the chemical conversion-treated metal substrate was washed with water by a spray treatment with tap water for 30 seconds, and subsequently washed with water by a spray treatment with ion-exchanged water for 10 seconds. Next, after the water-washing treatment, an electrodeposition coat film was formed on the metal substrate in a wet state by using a cationic electrodeposition coating material (manufactured by Nippon Paint Co., Ltd under the trade name of "POWERNICS 110"). Note that the thus formed electrodeposition coat film had a film thickness (a dry film thickness after the electrodeposition) of 20 μm. Then, the metal substrate on which the electrodeposition coat film was formed was baked by heating at 170° C. for 20 minutes. Thus, the sample substrate (I) was produced.

[Production of Sample Substrates (II)]

An electrodeposition coat film was formed and baked on each of the chemical conversion-treated metal substrates obtained in Examples and Comparative Examples in the same manner as in the method for producing sample substrate (I) except that, in the baking of the metal substrate on which the electrodeposition coat film was formed, the temperature condition was changed from 170° C. to 160° C., and the baking time was changed from 20 minutes to 10 minutes. Thus, each of the sample substrates (II) was produced.

TABLE 3

| | Content of each element in coating film (Unit: mg/m$^2$) | | Secondary adhesion (SDT) (Unit: mm) | |
|---|---|---|---|---|
| | | | Sample substrate (I) | Sample Substrate (II) |
| | Zr | Si | [High-temp. baking] | [Low-temp. baking] |
| Example 1 | 37.7 | 7.0 | 0.0 | 0.0 |
| Example 2 | 43.6 | 4.7 | 0.6 | 0.0 |
| Example 3 | 51.4 | 4.9 | 0.0 | 0.0 |
| Example 4 | 33.6 | 6.1 | 0.0 | 0.0 |
| Example 5 | 45.6 | 5.1 | 0.7 | 0.8 |
| Example 6 | 46.5 | 6.7 | 1.6 | 0.0 |
| Example 7 | 47.1 | 6.2 | 0.8 | 0.9 |
| Example 8 | 42.1 | 4.6 | 0.7 | 1.1 |
| Example 9 | 66.0 | 9.9 | 0.0 | 1.1 |
| Example 10 | 40.8 | 4.0 | 0.0 | 1.6 |
| Example 11 | 39.7 | 4.0 | 0.8 | 0.0 |
| Example 12 | 39.3 | 7.2 | 0.0 | 0.0 |
| Example 13 | 58.9 | 7.1 | 0.0 | 0.0 |
| Example 14 | 32.6 | 4.5 | 1.2 | — |
| Example 15 | 33.6 | 6.1 | 0.0 | 0.0 |
| Example 16 | 45.2 | 6.9 | 0.0 | 0.0 |
| Example 17 | 23.1 | 6.5 | 0.0 | 0.0 |
| Example 18 | 27.1 | 5.9 | 0.8 | 0.8 |
| Example 19 | 43.9 | 6.8 | 0.0 | 0.0 |
| Example 20 | 34.5 | 5.8 | 0.5 | 0.4 |
| Example 21 | 30.1 | 7.3 | 0.0 | 0.0 |
| Comp. Ex. 1 | 42.3 | 4.8 | 2.2 | 2.7 |
| Comp. Ex. 2 | 29.9 | 4.5 | 2.2 | 5.6 |
| Comp. Ex. 3 | 57.4 | 4.2 | 0.0 | 5.4 |
| Comp. Ex. 4 | 79.5 | 0.0 | 14.2 | 9.5 |
| Comp. Ex. 5 | 80.8 | 0.6 | 8.8 | 3.2 |
| Comp. Ex. 6 | 30.9 | 6.7 | 4.4 | 6.3 |
| Comp. Ex. 7 | 26.7 | 5.6 | 6.3 | 8.3 |
| Comp. Ex. 8 | 45.0 | 2.2 | 8.8 | — |
| Comp. Ex. 9 | Not determined (zinc phosphate was used) | | 1.7 | 5.5 |

As is apparent from the results shown in Table 3, can be understood that the chemical conversion coating films were formed with sufficient coated amounts in the cases (Examples 1 to 21) where the chemical conversion coating films of the chemical conversion treatment were formed on the surfaces of the metal substrates by using the chemical conversion treatment agents of the present invention. In addition, in the cases (Examples 1 to 21) where the chemical conversion coating films were formed on the surfaces of the metal substrates by using the chemical conversion treatment agents of the present invention, the maximum width of the coating material adhered to the peeled adhesive tape was 1.6 or less in each of the cases where the coat film was baked at 170° C. (the production condition for the sample substrates (I)) and where the coat film was baked at 160° C. (the production condition for the sample substrates (II)). Hence, it was found that the formed chemical conversion coating films had extremely high levels of coat film adhesions. In addition, also when the chemical conversion treatment agents obtained in Examples 14 and 15 were used, the results of the SDT were sufficiently high. Hence, it has been found that the chemical conversion treatment agent of the present invention is also excellent in storage stability.

INDUSTRIAL APPLICABILITY

As described above, the present invention makes it possible to provide a chemical conversion treatment agent for surface treatment of a metal substrate, the chemical conversion treatment agent being capable of imparting a sufficiently high level of coat film adhesion, and to provide a method for surface treatment of a metal substrate using the chemical conversion treatment. Hence, the chemical conversion treatment agent of the present invention is especially useful as a chemical conversion treatment agent used for a chemical conversion treatment on surfaces of uncoated vehicle outer panels, such as automobile bodies and two-wheel vehicle bodies, various parts, outer surfaces of containers, and metal substrates to be subjected to coating treatments such as coil coating.

The invention claimed is:

1. A chemical conversion treatment agent for surface treating a metal substrate, comprising:

at least one metal element selected from the group consisting of zirconium, titanium, and hafnium;

a fluorine element; and a co-condensate of a first silane coupling agent (A) and a second silane coupling agent (B), wherein the first silane coupling agent (A) having a tri-or di-alkoxysilane group and an amino group, and the second silane coupling agent (B) is represented by formula (1):

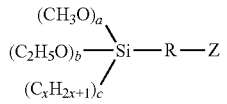

(1)

wherein

R is selected from the group consisting of alkylene groups having 1 to 5 carbon atoms, alkyleneoxy groups having 1 to 5 carbon atoms, and an oxygen atom, Z is selected from the group consisting of cyclohexyl groups each optionally having at least one of an epoxy group and an amino group as a substituent and aromatic ring groups each optionally having at least one of a vinyl group, an epoxy group, and an amino group as a substituent, a, b, and c are each an integer of 0 to 3, provided that a sum of a, b, and c is 3, and a sum of a and b is 2 to 3, and x is an integer of 1 to 3.

2. The chemical conversion treatment agent according to claim 1, wherein the first silane coupling agent (A) is selected from the group consisting of 3-aminopropyltriethoxysilane, 3-aminopropyltrimethoxysilane, 3-aminopropylmethyldiethoxysilane, 3-aminopropylmethyldimethoxysilane, N-(2-aminoethyl)-3-aminopropyltrimethoxysilane, N-(2-aminoethyl)-3-aminopropylmethyldimethoxysilane, N-(2-aminoethyl)-3-aminopropyltriethoxysilane, N-(2-aminoethyl)-3-aminopropyldimethoxysilane, and any given mixture thereof.

3. The chemical conversion treatment agent according to claim 1, wherein

Z is a member selected from the group consisting of a 3,4-epoxycyclohexyl group, a phenyl group, a cyclohexyl group and a styryl group.

4. The chemical conversion treatment agent according to claim 1, further comprising at least one member selected from the group consisting of aluminum, magnesium, zinc, calcium, strontium, indium, tin, copper and silver.

5. The chemical conversion treatment agent according to claim 1, wherein the co-condensate of the first silane coupling agent (A) and the second silane coupling agent (B) is a co-condensate obtained by polymerizing a mixture of the first silane coupling agent (A) and the second silane coupling agent (B) in a mass ratio ((A):(B)) which is in a range from 1:9 to 18:1.

6. The chemical conversion treatment agent according to claim 1, wherein a content of the metal element is 50 to 1000 ppm in terms of the element.

7. The chemical conversion treatment agent according to claim 1, wherein a total content of the first silane coupling agent (A) and the second silane coupling agent (B), including the co-condensate, is 200 ppm or more in terms of solid content concentration.

8. The chemical conversion treatment agent according to claim 1, wherein the fluorine element is partially present as free fluorine ions in the chemical conversion treatment agent, and a content of the free fluorine ions in the chemical conversion treatment agent is in a range of from 0.01 to 100 ppm.

9. A method for surface treating a metal substrate, the method comprising the steps of bringing the chemical conversion treatment agent according to claim 1 into contact with a surface of a metal substrate, to thereby form a chemical conversion coating film on the surface of the metal substrate.

10. The chemical conversion treatment agent according to claim 2, wherein

Z is a member selected from the group consisting of a 3,4-epoxycyclohexyl group, a phenyl group, a cyclohexyl group and a styryl group.

11. The chemical conversion treatment agent according to claim 2, further comprising at least one member selected from the group consisting of aluminum, magnesium, zinc, calcium, strontium, indium, tin, copper and silver.

12. The chemical conversion treatment agent according to claim 3, further comprising at least one member selected from the group consisting of aluminum, magnesium, zinc, calcium, strontium, indium, tin, copper and silver.

13. The chemical conversion treatment agent according to claim 2, wherein the co-condensate of the first silane coupling agent (A) and the second silane coupling agent (B) is a co-condensate obtained by polymerizing a mixture of the first silane coupling agent (A) and the second silane coupling agent (B) in a mass ratio ((A):(B)) which is in a range from 1:9 to 18:1.

14. The chemical conversion treatment agent according to claim 3, wherein the co-condensate of the first silane coupling agent (A) and the second silane coupling agent (B) is a co-condensate obtained by polymerizing a mixture of the first silane coupling agent (A) and the second silane coupling agent (B) in a mass ratio ((A):(B)) which is in a range from 1:9 to 18:1.

15. The chemical conversion treatment agent according to claim 4, wherein the co-condensate of the first silane coupling agent (A) and the second silane coupling agent (B) is a co-condensate obtained by polymerizing a mixture of the first silane coupling agent (A) and the second silane coupling agent (B) in a mass ratio ((A):(B)) which is in a range from 1:9 to 18:1.

16. The chemical conversion treatment agent according to claim 2, wherein a content of the metal element is 50 to 1000 ppm in terms of the element.

17. The chemical conversion treatment agent according to claim 3, wherein a content of the metal element is 50 to 1000 ppm in terms of the element.

18. The chemical conversion treatment agent according to claim 4, wherein a content of the metal element is 50 to 1000 ppm in terms of the element.

19. The chemical conversion treatment agent according to claim 5, wherein a content of the metal element is 50 to 1000 ppm in terms of the element.

20. The chemical conversion treatment agent according to claim 2, wherein the fluorine element is partially present as free fluorine ions in the chemical conversion treatment agent, and a content of the free fluorine ions in the chemical conversion treatment agent is 0.01 to 100 ppm.

21. The chemical conversion treatment agent according to claim 2, wherein the co-condensate of the first silane coupling agent (A) and the second silane coupling agent (B) is a co-condensate obtained by polymerizing a mixture of the first silane coupling agent (A) and the second silane coupling agent (B) in a mass ratio ((A):(B)) which is in a range from 7:3 to 9:1.

* * * * *